United States Patent [19]

Bolton et al.

[11] Patent Number: 4,573,328

[45] Date of Patent: Mar. 4, 1986

[54] APPARATUS FOR MOUNTING A PACKAGED TERMINAL AIR CONTROLLER TO A PLASTIC WELL SLEEVE

[75] Inventors: Theodore S. Bolton, Liverpool; John H. Michaels, Clay, both of N.Y.

[73] Assignee: Carrier Corporation, Syracuse, N.Y.

[21] Appl. No.: 698,203

[22] Filed: Feb. 4, 1985

[51] Int. Cl.[4] ..... F25D 23/12

[52] U.S. Cl. ..... 62/263; 98/114; 248/27.1; 312/101; 411/172

[58] Field of Search ..... 62/263; 98/114; 312/101, 245, 257 SM; 411/172, 173, 174, 175; 248/27.1

[56] References Cited

U.S. PATENT DOCUMENTS

| | | | |
|---|---|---|---|
| 2,233,230 | 2/1941 | Tinnerman | 411/175 |
| 2,679,796 | 6/1954 | Froelich et al. | 98/114 |
| 3,308,634 | 3/1967 | Smith | 62/263 |
| 4,274,330 | 6/1981 | Witten et al. | 98/114 |
| 4,325,229 | 4/1982 | DeZurik | 98/114 |

*Primary Examiner*—Ronald C. Capossela
*Attorney, Agent, or Firm*—Robert H. Kelly

[57] ABSTRACT

A plastic sleeve assembly and an air conditioning unit are disclosed for mounting the air conditioning unit in a through-the-wall application. The sleeve assembly includes flange members with transverse ribs therebetween. The flanges have screw holes therethrough with a J-nut about the inner screw hole, and standoffs about the outer screw holes, such that the air conditioning unit, having an L-shaped sealing flange thereon, when inserted into the sleeve and fastened thereto, causes the standoff on the flange to be in compression and not tension as a fastener secures the air conditioner in the sleeve.

4 Claims, 3 Drawing Figures

APPARATUS FOR MOUNTING A PACKAGED TERMINAL AIR CONTROLLER TO A PLASTIC WELL SLEEVE

BACKGROUND OF THE INVENTION

This invention relates generally to a through-the-wall sleeve for a packaged terminal air conditioning unit. More specifically, the present invention relates to a non-metallic wall sleeve including an improved mounting means for securing the chassis of a packaged terminal air conditioning unit having an L-shaped weather strip angle to the flange of the sleeve.

Air conditioning units which are commonly used for light commercial applications such as hotels, dormitories, and office buildings often are of the type known as a packaged terminal air conditioner. These packaged terminal air conditioners extend through the wall of the enclosure and normally have a condensing section located in communication with the ambient air for discharging heat energy. An evaporator section is provided in communication with the enclosure air for conditioning said air as it is drawn through the unit. Packaged terminal air conditioning units may be designed such that a portion of the unit is encased within the wall in a sleeve. The remaining portion of the unit is typically located within the enclosure to be conditioned and has readily accessible controls thereon and is encased within a decorative cover.

Normally, through-the-wall installation can be made in masonry or wood frame walls by installing the sleeve through the wall during the construction of the building and installing the air conditioning unit in the sleeve upon completion of the building.

Previous wall sleeves for packaged terminal air conditioners have been constructed from metal sheets (these sleeves will also accept heat pump units and the like). This type of wall sleeve comprises a box formed by a top, a bottom, and two sides, but having the front and back open. Generally, a grille is fastened to the rear or outside opening, while the air conditioner unit is introduced into the sleeve through the front opening. The front opening of the sleeve is bound by a flange or molding formed by bending the front edges of the top, the two sides and the bottom at right angles to form four flanges lying in the same plane with the long leg of an L-shaped weather sealing flange attached vertically along the sides of the air conditioning unit chassis. Accordingly, when the unit chassis is introduced into the sleeve the short leg of the L-shaped weather sealing flange mates perpendicularly with the side flanges on the sleeve while a gap is left between the flange of the sleeve and the long leg of the weather sealing flange of the air conditioning unit. Gasket material or weather tight caulking is generally applied in the gap between the sleeve and the air conditioning unit to insure a weather tight installation. However, when screws installed through the weather sealing flange of the air conditioning unit and the flange of the wall sleeve are tightened to secure the air conditioner chassis to the sleeve, the metal flange of the sleeve is distorted as the weather tight caulking is compressed between the wall sleeve and the air conditioning unit. This distortion of the flanges was not detrimental to the metal sleeve, since the material around the fastener holes in the sleeve was not broken and the air conditioning unit could be removed and replaced and the mounting screws could still be secured through the weather sealing flange to the distorted wall sleeve flange.

However, with the introduction of non-metallic sleeves, the flanges on the sleeves did not distort when the mounting screws for securing the air conditioning unit chassis to the flanges of the sleeve were tightened, but the sleeve flange fractured because the sleeve flange was pulled into contact with the long leg of the L-shaped weather sealing flange of the chassis. This problem was solved, however, by ensuring that a pad of material around the screw hole in the sleeve flange was loaded in compression when the chassis was inserted in and fastened to the sleeve. The material was loaded in compression by installing a standoff around the screw hole which made contact with the long leg of the L-shaped flange. However, under certain conditions the sleeve flange could not be loaded in compression, and could still be broken when the chassis was fastened to the sleeve. For example, when the chassis was prevented from sliding completely into the sleeve by a foreign object in the sleeve, the L-shaped weather sealing flange of the chassis did not contact the standoff and when the fastener was over torqued, the sleeve flange broke.

SUMMARY OF THE INVENTION

Therefore, it is an object of the present invention to provide a unitary non-metallic wall sleeve for a packaged terminal air conditioner.

It is another object of the present invention to provide a non-metallic wall sleeve for a packaged terminal air conditioner such that the flanges around the wall sleeve will not break when the air conditioning unit is prevented from being completely installed into and secured to the sleeve with a plurality of fasteners.

These and other objects are achieved according to a preferred embodiment of the present invention by providing a plastic wall sleeve having two flanges, an outside and inside flange, each with an aperture used for receiving the fasteners for securing the air conditioner chassis to the sleeve. The inside flange is parallel to the outside flange. The outside flange is formed around the inside perimeter of the sleeve near the front end, while the inside flange is spaced from the outside flange and a second aperture in the inside flange is concentric with the first aperture in the outer flange whereby a mounting screw is insertable through the first aperture and is secured to a nut at the second aperture. The inside and outside flanges are maintained in spaced apart relation by support ribs extending from the wall of the sleeve between the two flanges.

The various features of novelty which characterize the invention are pointed out with particularity in the claims annexed to and forming a part of this specification. For a better understanding of the invention, its operating advantages, and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

The preferred embodiment described herein will refer to a non-metallic through-the-wall sleeve and air conditioning unit chassis for use as a packaged terminal air conditioning unit. It is to be understood that this invention has like applicability to other types of packaged terminal units including heat pumps, electric resistance heaters, unitary hydronic units, and other similar applications.

Figure 1:
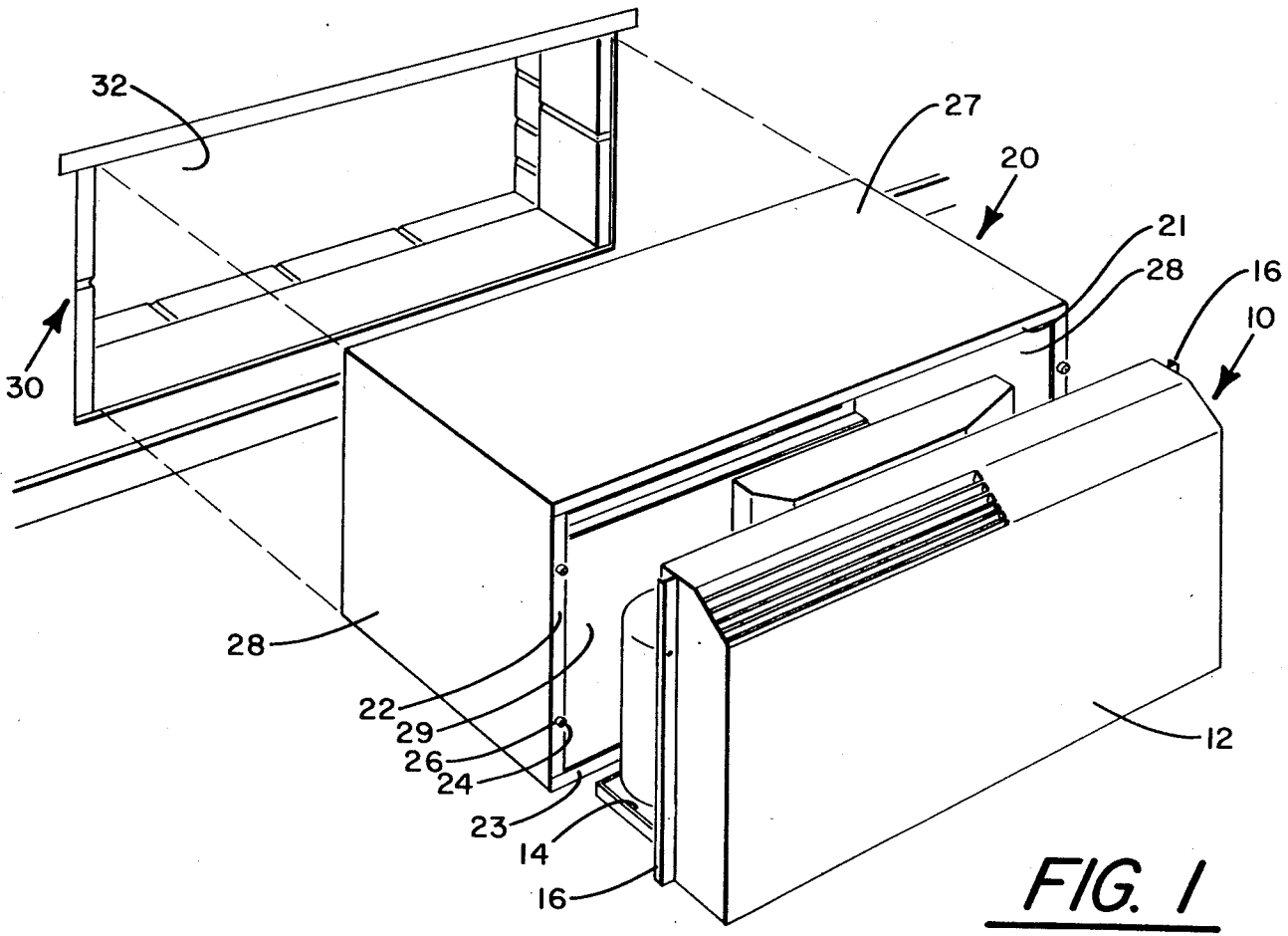
FIG. 1 is an exploded perspective view of a packaged terminal air conditioning unit insertable in a through-the-wall sleeve.

Referring first to FIG. 1 there may be seen a packaged terminal air conditioning unit 10 having front cover 12 and chassis 14. The packaged terminal air conditioning unit is installed in a sleeve 20. The sleeve may be made from a thermoplastic or thermoset material, such as, glass reinforced molded polyester manufactured by Premix Inc. of No. Kingsville, Ohio. The sleeve 20 is typically mounted within the wall 30 enclosure such that the front cover 12 is visible to an occupant of the enclosure while the remainder of the unit is supported in a aperture 32 in the wall 30 of the enclosure. The sleeve 20 is box-like in shape having a top 27, two sides 28, and a bottom 29 wherein the front and back are open. The front opening of the sleeve 20 has molding, generally perpendicular to the top, bottom and side surfaces of the sleeve, forming top flange 21, bottom flange 23, and side flanges 22.

As seen in FIG. 1, the chassis 14 has an L-shaped mounting flange 16 attached to the sides thereof. This mounting flange may be a piece of angle stock secured to the chassis by welding or the like. The mounting flange is adapted to coact with side flanges 22 of the sleeve 20 to secure the unit 10 to the sleeve 20.

Figure 2:
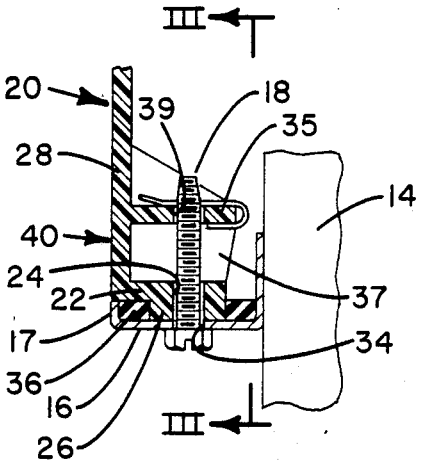
FIG. 2 is a plan view, partly in section, of a fastener means securing a packaged terminal air conditioner to a wall sleeve utilizing the present invention.

Referring now to FIG. 2 there may be seen a sectioned plan view of part of the unit 10 enclosed in the sleeve 20. The chassis 14 has the L-shaped mounting flange 16 attached thereto. The chassis 14 of the unit 10 is secured to the sleeve 20 by fasteners 18.

For securing the chassis 14 to the sleeve 20 with the fasteners 18, side flanges 22 are molded perpendicularly inward and have aperture 24 therethrough while the L-shaped mounting flange 16 has a corresponding aperture 34 through the long side of the L-shaped mounting flange. Spaced from and parallel to the side flanges 22 are inside flanges 35. Support ribs 37 extend between side flange 22 and inside flange 35 and protrude from the side walls 28. The side flange 22, inside flange 35, and plurality of support ribs 37 form a rectangular fastener receiving means 40 which prevents the flange 22 from fracturing if an attempt is made to fasten the chassis to the sleeve when the chassis is slid into the sleeve at an angle or is not slid completely into the sleeve. The inside flange 35 has an aperture 39 therethrough. The aperture 39 is concentric about the axis passing through the aperture 24 of the side flange 22. For securing the chassis 14 in place in the sleeve 20 with fastener 18, nut 19, such as a J-speed nut, is provided at each aperture 39 in the inside flange 35.

A weather tight seal is maintained between the chassis 14 and the sleeve 20 by gasket material 36. Further, an embossment or standoff 26 is provided between the side flange 22 and the L-shaped mounting flange 16. The embossment 26 extends around the aperture 24 in the side flange 22 and the aperture 24 continues through the embossment. Moreover, the height or thickness of the embossment 26 is generally equivalent to the length of the short leg 17 of the L-shaped mounting flange 16. Thus, when the L-shaped mounting flange of the chassis 14 is secured to the side flanges 22 of the sleeve 20 by fastener 18, the gasket material 36 is compressed to a depth no less than the height of the embossment or standoff 26. When the fastener 18 is fully torqued, even if the chassis is not inserted into the sleeve all the way, the fastener receiving means 40 is under compression and there is no rotational force on the side flange 22 of the sleeve 20 to fracture it at the junction of the side wall 28 and the side flange 22. Accordingly, the chassis is now secured and sealed to the sleeve without damage to the apertures or the side flanges of the sleeve.

Figure 3:
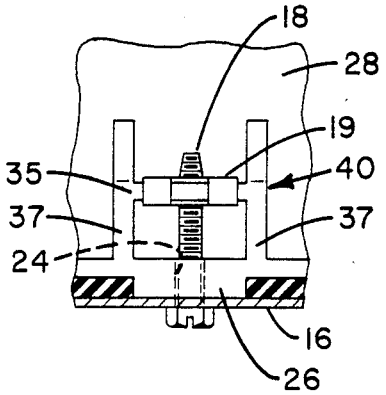
FIG. 3 is an elevation view of a portion of a wall sleeve taken along line III—III of FIG. 2.

Referring now to FIG. 3 there can be seen an elevation view of the sleeve 20 showing the J-nut 19 attached to the inside flange 35 and the embossment 26 circumscribed about the aperture 24 in the side flange 22. The embossment 26 is generally molded in circular form into the sleeve 20, but can be of various shapes such as rectangular, crescent, oval or the like, as long as its height is generally equivalent to the length of the short leg 17 of the L-shaped mounting flange 16. Support ribs 37 protrude from the side wall 28 and extend generally perpendicularly between the side flange 22 and the inside flange 35.

It is contemplated that each side flange 22 of the sleeve 20 has a plurality of embossments with apertures 24 therethrough and an inside flange 35 corresponding to each aperture 24. Further, each inside flange 35 has a J-nut 19 or the like therearound its aperture 39 to receive a fastener 18 insertable in a corresponding aperture 34 of the L-shaped mounting flange of the chassis. Once the chassis 14 is inserted in the sleeve 20 the fasteners 18 are used to secure the chassis in position. However, the fastener receiving means 40 prevents the side flange 22 from fracturing when the fastener 18 is torqued but the chassis is not slid completely into the sleeve.

Hence, as has been described herein a packaged terminal air conditioner may be secured to a plastic wall sleeve without breaking the flange of the sleeve at the junction of the sleeve and the side wall.

The invention has been described with reference to a particular embodiment, however, it is to be understood by those skilled in the art that variations and modifications can be made within the spirit and scope of the invention.

What is claimed is:

1. A non-metallic sleeve for removably mounting therein a packaged terminal air conditioning unit having an L-shaped sealing flange extending outwardly therefrom, comprising:

a box means formed by a top, a bottom, two sides, an open back, and an open front;

a pair of flanges carried by opposite sides of said box means, said flanges extending inwardly in the plane of said open front, said flanges having aperture means therethrough for receiving fastener means extending through the L-shaped sealing flange for securing the packaged terminal air conditioning unit in the sleeve, standoff means in axial alignment with said aperture means adapted to keep said flanges in spaced relation to the L-shaped sealing flange, said standoff means has a height substantially equal to the short leg of the L-shaped sealing flange to keep said two flanges in compression when said fastener means is tightened, and nut means for securing said fastener means, said nut means having a flange means extending from opposite sides of said box means in parallel spaced relation to each of said pair of flanges.

2. The non-metallic sleeve as set forth in claim 1 wherein said nut means includes a J-nut for receiving said fastener means.

3. The non-metallic sleeve as set forth in claim 2 wherein said nut means further includes rib means extending from said opposite sides of said box means transverse to said flanges in the plane of said open front and said flange means spaced parallel therefrom.

4. The non-metallic sleeve as set forth in claim 3 wherein said sleeve is a thermoset polyester.

* * * * *